United States Patent [19]

Cushing

[11] Patent Number: 4,890,342

[45] Date of Patent: Jan. 2, 1990

[54] SWIMMING POOL PROTECTOR AND CONVERTER

[76] Inventor: R. Rand Cushing, 536 Broad St., Weymouth, Mass. 02189

[21] Appl. No.: 276,915

[22] Filed: Nov. 28, 1988

Related U.S. Application Data

[63] Continuation-in-part of Ser. No. 126,610, Nov. 30, 1987, Pat. No. 4,807,309.

[51] Int. Cl.[4] ..... E04H 3/18

[52] U.S. Cl. ..... 4/494

[58] Field of Search ..... 4/494–496, 4/498, 503, 504, 506, 513; 272/3

[56] References Cited

U.S. PATENT DOCUMENTS

| | | | |
|---|---|---|---|
| 1,918,437 | 7/1933 | Torrance | 4/494 X |
| 3,347,006 | 10/1967 | Fox | 4/506 X |
| 3,464,067 | 9/1969 | Hauck | 4/506 X |
| 3,628,198 | 12/1971 | Katzmann | 4/506 X |
| 3,639,921 | 2/1972 | Siler | 4/494 |
| 3,641,595 | 2/1972 | Viessmann | 4/506 X |
| 3,648,303 | 3/1972 | Stewart et al. | 4/506 X |
| 3,797,049 | 3/1974 | DeSanto | 4/506 X |

*Primary Examiner*—Charles E. Phillips

*Attorney, Agent, or Firm*—M. Lawrence Oliverio

[57] ABSTRACT

Apparatus for converting a swimming pool into a skating rink and preserving the structural integrity of the pool, the pool comprising a water basin having a rim extending around the top edge of the basin, the basin being filled with water up to a predetermined level below the rim, the apparatus comprising a plurality of impact resistant cornices overlying the rim and extending around the circumference of the pool in sequential array; each cornice comprising a top plate overlying the top edge of the pool and a flange plate attached to and extending the length of the forward edge of the top plate, the flange plate extending downwardly into the basin a predetermined level below the surface of the water within the basin; the cornices being sequentially arranged around the rim of the pool such that the left side of the flange plate of each cornice is aligned substantially parallel to and closely adjacent to the right side of the flange plate of each immediately adjacent cornice.

3 Claims, 3 Drawing Sheets

SWIMMING POOL PROTECTOR AND CONVERTER

This is a continuation-in-part application of my copending U.S. Pat. application Ser. No. 126,610 filed Nov. 30, 1987 now U.S. Pat. No. 4,807,30.

BACKGROUND OF THE INVENTION

The present invention relates to an apparatus for converting swimming pools of essentially any size and shape into a skating rink in winter weather and preserving and protecting the structural integrity of the pool.

SUMMARY OF THE INVENTION

Swimming pools exist in a wide variety of shapes and sizes. Although it is theoretically possible to simply fill a swimming pool with water and allow the water to freeze for purposes of using the pool as a skating rink in winter, the practical problem in doing so is that the top coping portion and the upper edge of the pool near the rim which is not covered with ice are exposed to impact with the skater's skates and consequent damage. If the skater is playing hockey on the surface of the pool, similar damage from impact with a hockey puck may occur.

The problem of such damage occurring to the coping or upper exposed rim portion of a swimming pool is likely to occur in most pools even if the skater takes care to minimize such contact because any contact may tend to damage structurally sensitive materials which typically comprise the coping or upper edging of many if not most pools.

The present invention provides an apparatus for protecting such exposed areas from impact in a wide variety of pool shapes.

In accordance with the invention there is provided an apparatus for converting a swimming pool into a skating rink and preserving the structural integrity of the pool, the pool comprising a water basin having a rim extending around the top edge of the basin, the basin being filled with water up to a predetermined level below the rim, the apparatus comprising a plurality of impact resistant cornices overlying the rim and extending around the circumference of the pool in sequential array; each cornice comprising a top plate overlying the top edge of the pool and a flange plate attached to and extending the length of the forward edge of the top plate, the flange plate extending downwardly into the basin a predetermined level below the surface of the water within the basin; the cornices being sequentially arranged around the rim of the pool such that the left side of the flange plate of each cornice is aligned substantially parallel to and closely adjacent to the right side of the flange plate of each immediately adjacent cornice.

In one embodiment the top plate of each cornice may have a square or rectangular shape. Alternatively, the top plate of each cornice may have a straight forward edge and side edges which begin at the ends of the forward edge and diverge away from each other along straight or curved lines from the forward straight edge toward the rear of the top plate.

The left and right side edges of immediately adjacent flange plates are preferably rotatably connected; and, the top plate and the flange plate of each cornice are preferably integrally formed together as a unitary structure.

Where the top plate is square or rectangular, the top plate extends at least about 18 inches rearwardly and has a thickness of at least about 0.12 inches.

Where the top plate has divergent side edges, the side edges preferably diverge away from each other along a rearward divergent length of at least about 12 inches.

DETAILED DESCRIPTION OF THE INVENTION

Following is a description of a preferred embodiment(s) of the invention.

Figure 3:
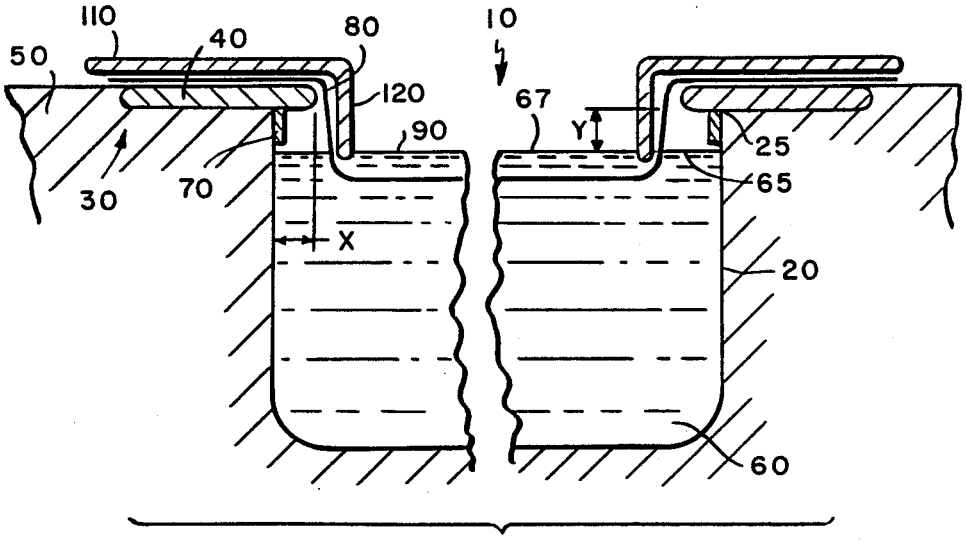
FIG. 3 is a side cross-sectional view of a swimming pool showing the relative positioning of cornice, coping, and tile elements and water in the basin of the pool.
Figure 4:
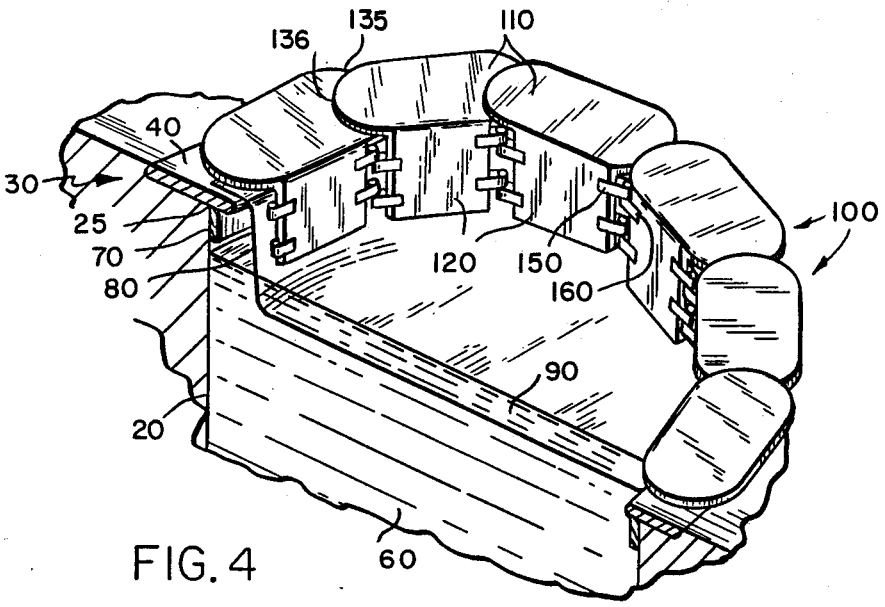
FIG. 4 is an isometric view of a portion of a swimming pool showing the successive arrangement of several cornices around a portion of the rim of the pool.
Figure 5:
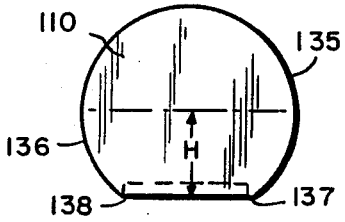
FIGS. 5–10 are top views of alternatively shaped top plates of cornices useable in the invention herein.
Figure 6:
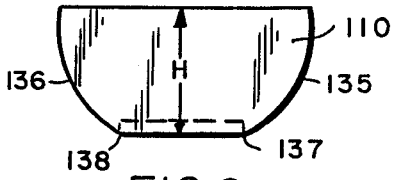
Figure 7:
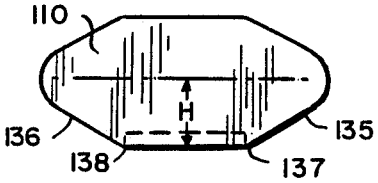
Figure 8:
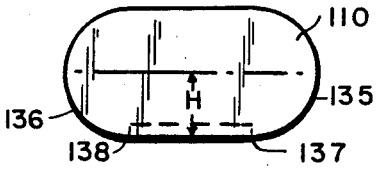
Figure 9:
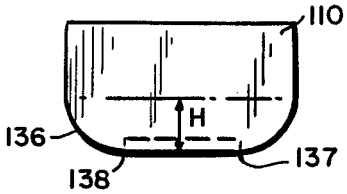
Figure 10:
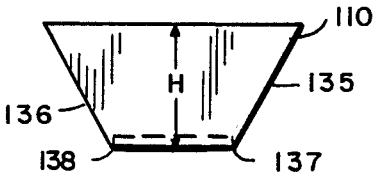

There is shown in FIGS. 3, 4 a swimming pool 10 comprising a basin 20 having a ledge 30 around the top rim 25 thereof. The ledge 30 typically comprises a relatively short coping portion 40 and a rearward flat walking surface 50 abutting the rear end of coping 40. In the embodiment shown in FIGS. 3, 4 for purpose of illustration only, the coping portion 40 protrudes laterally over the top edge or rim 25 of the basin a relatively short distance X, typically between about 2 and about 12 inches where such a protrusion may exist. In other pool embodiments, the inward edge of coping 40 may simply coincide with the top edge or rim 25 of the basin 20 such that the distance X is less than 2 inches or essentially zero.

In preparation of the pool 10 for use as a skating rink the supply of water 60 therein is typically maintained such that the top levels 65, 67 of the water 60 and 90 are maintained a relatively short distance Y below the ledge 30 such that an ice skater may conveniently step down from above ledge 30 on the skating surface 67. The distance Y is typically selected to be great enough to allow surfaces 65 and 67 to reside below the bottom of a tile edqinq 70 which is typically provided around the top edge of a pool 10 such that when the water 60 freezes the tile 70 is not damaged by the freezing water 60. Y is typically selected to be between about 6 and about 24 inches.

In the embodiment shown in FIG. 3 a cover sheet 80 may be provided which completely overlies the ledging 30, i.e. over the coping 40 and typically further over about a 4 inch or more length of walking surface 50, and further substantially completely overlies the portion of surface 65, if any, which lies below and between the inner edge of coping 40. As shown, the sheet 80, if provided, extends downwardly into basin 20 over surface 65 In converting the pool 10 into a skating rink, a pool of water 90 is provided on the top surface of sheet 80, preferably prior to the time when the main body of water 60 freezes. As shown in FIG. 3 when pool of water 90 is placed over sheet 80, the level 65 of water 60 will rise to coincide with the level 67 of pool of water 90. Thus when pool of water 90 is provided before the main body of water 80 has frozen, a continuous top level 65, 67 of water is established within basin 20. In any event, the top level 65, 67 of pool 90 with or without cover 80 is preferably maintained at a level such that level 65, 67 resides below the bottom surface of coping 40 such that a skater may conveniently step down from above coping 40 onto the surface 67, typically between about 6 and about 24 inches below coping 40.

In embodiments where a cover sheet is provided, sheet 80 typically comprises a water impervious plastic, canvas or similar material which is capable of preventing debris such as dirt, leaves and the like from passing therethrouqh into the main body of water 60. When the sheet 80 is selected to comprise a water impervious material, the sheet serves to define and separate the pool 90 of skating rink water from the main body 60 of basin 20 water. The sheet 80 is preferably relatively thin, e.g. between about 0.01 and about 0.6 inches, yet tough and tear resistant such that when subjected to the pressure of an ice skate blade the sheet 80 resists immediate tearing thereby minimizing or eliminating the possibility of an immediate puncture by a skater's skate and thus effecting a softening and slowing of an accidental fall through a thinly iced surface 67 into the main body of pool water 60. The sheet 80, if provided, may alternatively comprise a mesh material such as a fabric or screen which allows water to pass through the sheet 80 but not debris.

Figure 1:
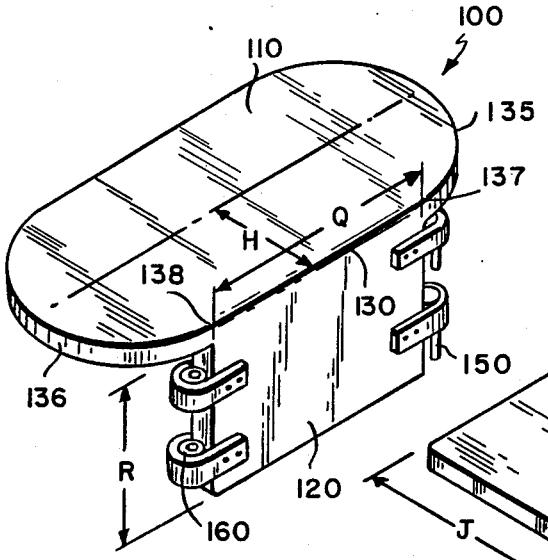
FIG. 1 is an isometric view of a cornice element according to the invention having a oval top plate.

With reference to FIGS. 1, 3, 4, each cornice 100 comprises a rearward top plate 110 and a forward rectangular (or square) flange plate 120. In the specific alternative embodiment shown in FIG. 1, the top plate 110 has an oval-like shape with left 136 and right 135 side edges which are about semicircular in shape, and a straight forward edge 130 having a length, Q. Forward edge 130 typically defines a common side with plate 120. Plates 110, 120 are preferably integrally formed together as a unitary structure such as by injection molding or the like. Such a unitary structure typically comprises a tough, puncture resistant, dimensionally stable material such as an impact resistant plastic, rubber, fiberglass, wood, metal or a combination thereof.

With reference to FIGS. 3, 4, the cornices 100 are positioned around the rim 25 of the pool 10 such that the top plates 110 overlie the ledge 30 and the portions of the sheet 80, if provided, which overlie the ledge 30.

Plates 120 in the exemplary embodiment shown in FIGS. 1, 3, 4, overlie the forward edges of coping 40 and the portions of sheet 80 which extend forwardly between the edge of coping 40 and the point of a first contact of sheet 80 with surface 65 of water 60. In a most preferred embodiment, the length, R, of plate 120 is selected to be so long as to extend downwardly into pool of water 90 below surfaces 65, 67. The precise length selected for R will depend upon the height selected for level 65, 67. As described above in a preferred embodiment where level 67 is selected to be between about 6 and about 24 inches below coping 40, the length R is preferably selected to be about 8 and about 26 inches. As can be seen from FIGS. 3, 4, plate 120 effectively covers sheet 80 and tile edqinq 70, if any, from contact from above the skating surface 67.

Figure 2:
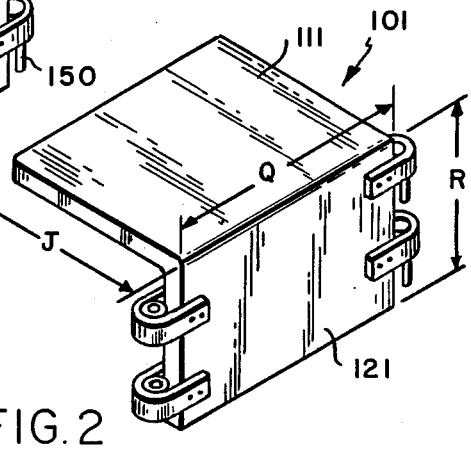
FIG. 2 is an isometric view of a cornice element according to the invention having a rectangular top plate.

In the embodiments of the invention shown in FIGS. 1, 2, 4, one side of the rectangular plates 120 (121) are provided with pin mechanisms 150 and the other side of the plates 120 (121) with complementary aperture mechanisms 160. As shown in FIG. 4, the cornices 100 are arranged around the leading 30 of the pool 10 such that the left and right sides of the flange plates 120 of adjacent cornices 100 are aligned substantially parallel to each other. As shown in FIG. 4, the pin mechanism 150 on one side of the plates 120 are inserted into the aperture or pin receiving mechanisms 160 provided on the other side of an immediately adjacent plate 120 such that the adjoined plates 120 are rotatable relative to each other by virtue of the pins 150, being rotatable within apertures 160. Such rotatable adjoinment of plates 120 allows successively adjoined cornices 100 to be readily adjoined and simultaneously positioned on top of the ledging 30 as shown in FIG. 4 regardless of the contour or curving of the rim 25 around the circumference of the pool 10. Such rotatable adjoinment also allows essentially all cornices 100 to be manufactured to a uniform size and all uniformly sized cornices to be readily positioned as shown in FIGS. 3, 4, around the entire circumference of essentially any shaped pool.

As shown in FIG. 4, successive cornices are arranged around and on top of ledge 30 such that the left and right sides of adjacent plates 120 of adjacent cornices 100 are relatively closely spaced together, i.e., less than a maximum distance of about 3 inches apart, thus obstructing an ice skate or other object from coming into contact with the sheet 80 or tiles 70, if provided, behind the plates 120. As can also be seen from FIG. 4, the sides 135, 136 of adjacently arranged cornices 100 overlap each other, even around the most severely curved portions of the circumference of the pool 10; such continuous overlapping of successive plates 110 thus effectively covers the entire upper ledge surface and other underlying elements, if any, and protects those elements from puncture, tear or other physical abuse by a skater using the pool 10 as a skating rink.

In cases where the rim 25 of a pool 10 is curved alone any substantial portion of the circumference, as for example shown in FIG. 4, the top plate of a cornice 100 is provided with side edges 135, 136, which continuously diverge away from each other from the points 137, 138, FIG. 1, 5–10, at which the sides 135, 136, begin at the straight forward edge 130. In such applications the side edges 135, 136 continue to diverge away from each other along a rearward length H normal to the straight forward edge 130. The length H, hereinafter referred to as "rearward divergent length" along which such side edge divergence preferably extends is at least about 12 inches. In applications where a portion of the rim 25 of the pool 10 may be curved as shown in FIG. 4, the rearwardly diverging side edges 135, 136 may result in a left side edge 136 overlying a right side edge 135 (or vice versa) around curved portions of the rim 25, or, at the very least, enable successive side edges 135, 136 to overlie portions of the ledging 30 which lie between successive cornices 100 around a curved rim portion.

FIGS. 5–10 illustrate a variety of alternative top plate 110 configurations having a variety of side edge configurations which continuously diverge away from each other over a rearward divergent length, H. Other plate 110 and rearwardly divergent side edge 135, 136 configurations can be imagined, the most preferred of which may vary with, among other things, the particular curvature of the rim of any given pool. Insofar as the rim of a pool may comprise straight edges such as in a substantially rectangular or square pool, the top plate 111 of a cornice 101 might alternatively be square or rectangular such as shown in FIG. 2. Although a cornice 101 configuration as shown in FIG. 2 may also be adapted to a pool having curved rim portions, a divergent side edge top plate 110, FIGS. 1, 5–10, configuration is preferred so as to insure better top plate coverage of the leading 30.

As shown in FIG. 4, the right side 135 of each plate 110 underlies the left side 136 of an adjacent plate 110. Such consecutive overlapping of a left side 135 over a right side 136 (or vice versa) is a most preferred embodiment of the apparatus of the invention in that any possibility of the left 135 and right 136 sides of a pair of plates 110 one removed from each other, interfering or abutting each other is minimized. As the alternative top plate 110 configurations shown in FIGS. 5–10 demonstrate, the decree of curvature or divergence of the side edges 135, 136, away from each other is a matter of choice which may be preselected according to the nature and degree of curvature of the rim around the circumference of the pool to be outfitted with the cornices. In terms of ease of manufacture, it is normally preferable to outfit a single pool with cornices all having the same top plate 100 (or 111) configuration, although in some applications a single pool may be outfitted with cornices having different top plate 110 configurations, e.g. alone straight edges of a pool cornices having square or rectangular top plates 111 may be used while around curved rim portions, a divergent side edge top plate 110 configuration FIGS. 5–10 may be used.

As shown in FIGS. 1, 5–10, each cornice 110 has a rearward divergent length H, a straight forward edge length Q and a flange plate length R. Most preferably, the height H is selected to be between about 12 and about 42 inches, length Q is selected to be between about two and about four feet and length R is selected to be between about 8 and about 26 inches. Similarly, cornice 111, FIG. 2, has a rearward length J which is typically between about 12 and 42 inches, a straight forward edge length Q of between about 2 and about 4 feet and a length R of between about 8 and about 26 inches. The preferred thickness of a top plate 110 111) will depend to a certain extent upon the selection of the height H, lengths Q and R, the primary considerations in selection of the thickness of plate 110 (111) being that the plate 110 (111) possess sufficient weight enough to remain relatively stationary upon placement over ledge 30 and sufficient thickness to resist puncture or breakage. Where the plates 110 comprise a high impact resistance fiberglass, plastic, rubber or other material and the preferred range of lengths Q, R, and H, are selected, the thickness of plate 110 111) is typically selected to be in the range of between about 0.125 and about 0.75 inches. In the preferred embodiment of the invention where the top plate 110 111) and flange plate 120 121 are formed together as an integral structure, the thickness of the plates 110, 120 (111, 121) are typically the same although such thickness may differ depending on the material(s) selected for use in constructing the cornices 100 (101).

As more fully described in my copending U.S. Pat. application Ser. No. 126,610, the disclosure of which is incorporated herein by reference, the forward edge 130 preferably includes a lip (not shown) which protrudes upwardly slightly from the otherwise flat top contour of plate 110. The lip is provided for purposes of allowing a person to manually grab onto the lip and pull himself up over the lip and onto the plate 110, e.g. in the event a skater falls through a thinly iced surface 67; such a lip also serves to cause rain and dirt and the like to wash rearwardly away from the basin of the pool.

As shown in FIG. 4, the bottom edges of plates 120 are preferably aligned with each other such that they all lie in a common horizontal plane. In embodiments where there is a successive overlapping of a left side 136 with a right side 135 (or vice versa), rectangular plates 120 (121) may become slightly skewed such that the bottom edges of plates 120 (121) are not precisely aligned so as to precisely be in a common horizontal plane. In order to impart the most desirable appearance to the apparatus, the left (or right) sides of plates 120 (121) may be constructed to be slightly longer than the right (or left) sides of plates 120 (121), e.g. by between about 0.1 to about 0.8 inches depending on the selected thickness of plates 110 (111), in order to insure that the bottom edges of plates 120 (121) are more precisely aligned so as to lie in a common horizontal plane.

The top plates 110 (111) may be tapered in thickness from their side edges 135, 136 toward the middle of the plates 110 (111) for purposes of more readily enabling the sequential overlapping and underlying of sides 135, 136, between adjacent cornices 100 (101), The thickness of the plates 110 (111) may alternatively be uniform throughout such that the bottom surface of plate 110 (111) is flat, such an embodiment being preferred for purposes of ease of manufacture.

Figure 11:
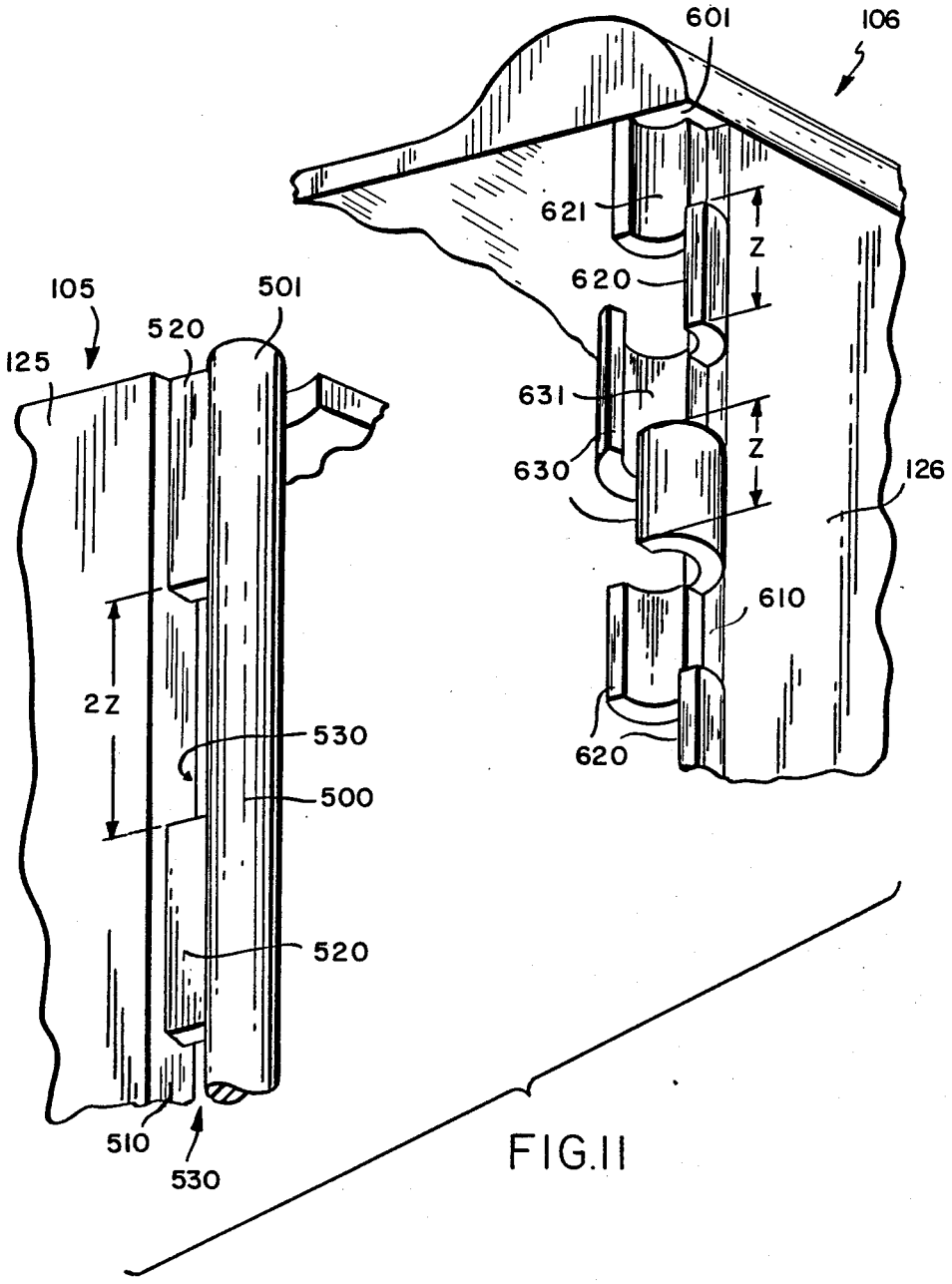
FIG. 11 is an isometric view of a preferred rotatable attachment mechanism for the flange plates of the cornices according to the invention.

For purposes of ease of illustration, FIGS. 1, 2, 4, show embodiments where pin mechanisms 150 and pin receiving mechanisms 160 are employed for rotatably connecting the left and right sides of adjacent plates 120. The sides of plates 120 may, however be rotatably connected in a variety of manners such that the sides are maintained substantially parallel to each other. One alternative means of rotatably adjoining the sides of plates 120 (121) is shown in FIG. 11, wherein a pin 500 is attached to the right side edge 510 of a flange plate 125 of one cornice 105 and a mechanism 600 for receiving pin 500 is attached to the left side edge 610 of a flange plate 126 of another cornice 106. The pin 500 and receiving mechanism 600 typically extend a portion of the length of the flange plates 125, 126 and are integrally formed therewith such as by molding. In a specific embodiment of the FIG. 11 rotatable attachment mechanism, the receiving mechanism 600 comprises an alternating series of pairs of shortened arc fingers 620 and pairs of longer arc fingers 630. Each of the fingers 620, 630, has a length Z. The pin 500 may be slid or otherwise snap fit into the receiving aperture formed by the inside surfaces 621, 631 of fingers 620, 630. The pin 500 is connected to the side edge 510 by connectors 520 such that slots 530 are provided between the pin 500 and the side edge 510. The slots 530 and the connectors 520 have a length of 2Z and are positioned along the length of pin 500 such that when the top 501 of pin 500 abuts the top 601 of the aperture of receiving mechanism 600, the pairs of longer arc pins 630 are aligned with slots 530. Such alignment of fingers 630 with slots 530 allows finders 630 to rotate around pin 500 and through slots 530. In such an alignment connectors 520 coincide with pairs of the shortened fingers 620 which limit the degree of rotation of pin 500 within mechanism 600 and thus the degree of rotation of plates 125 and 126 relative t each other. Typically the shortened arc fingers 620 are selected to have an arc of at most about 90 degrees thus allowing the pin 500 and plates 125, 126 to rotate through an arc of at least about 180 degrees.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. Apparatus for converting a swimming pool into a skating rink and preserving the structural integrity of the pool, the pool comprising a water basin having a rim extending around the top edge of the basin, the basin being filled with water up to a predetermined level below the rim, the apparatus comprising:

a plurality of impact resistant cornices overlying the rim and extending around the circumference of the pool in sequential array;

each cornice comprising a top plate overlying the top edge of the pool, the top plate having a forward edge to be located over said basin and a flange plate attached to and extending the length of the forward edge of the top plate, the flange plate extending downwardly into the basin a predetermined level below the surface of the water within the basin;

the cornices being sequentially arranged around the rim of the pool such that the left side of the flange plate of each cornice is aligned substantially parallel to and closely adjacent to the right side of the flange plate of each immediately adjacent cornice;

wherein the left and right side edges of immediately adjacent flange plates are rotatable connected.

2. Apparatus for converting a swimming pool into a skating rink and preserving the structural integrity of the pool, the pool comprising a water basin having a rim extending around the top edge of the basin, the basin being filled with water up to a predetermined level below the rim, the apparatus comprising:

a plurality of impact resistant cornices overlying the rim and extending around the circumference of the pool in sequential array;

each cornice comprising a top plate overlying the rim, the top plate having a forward edge to be located over said basin and a flange plate attached to and extending the length of the forward edges of the top plate, the flange plate extending downwardly into the basin a predetermined level below the surface of the water within the basin;

the top plate of each cornice having a square or rectangular shape and being integrally formed together with the flange plate as a unitary structure; the cornices being sequentially arranged around the rim of the pool such that the left side of the flange plate of each cornice is aligned substantially parallel to and closely adjacent to the right side of the flange plate of each immediately adjacent cornice;

wherein the left side of the flange plate of each cornice is rotatably connected to the right side of the flange plate of each immediately adjacent cornice.

3. Apparatus for converting a swimming pool into a skating rink and preserving the structural integrity of the pool, the pool comprising a water basin having a rim extending around the top edge of the basin, the basin being filled with water up to a predetermined level below the rim, the apparatus comprising:

a plurality of impact resistant cornices overlying the rim and extending around the circumference of the pool in sequential array;

each cornice comprising a top plate overlying the top edge of the pool, the top plate having a forward edge to be located over said basin and a flange plate attached to and extending the length of the forward edges of the top plate, the flange plate extending downwardly into the basin a predetermined level below the surface of the water within the basin;

the top plate of each cornice having a straight forward edge and side edges beginning at the ends of the forward edge and diverging away from each other along straight or curved lines from the forward straight edge toward the rear of the top plate;

the cornices being sequentially arranged around the rim of the pool such that the left side of the flange plate of each cornice is aligned substantially parallel to and closely adjacent to the right side of the flange plate of each immediately adjacent cornice;

wherein the left side of the flange plate of each cornice is rotatably connected to the right side of the flange plate of each immediately adjacent cornice.

* * * * *